US009351345B2

(12) United States Patent
Aizawa et al.

(10) Patent No.: US 9,351,345 B2
(45) Date of Patent: May 24, 2016

(54) METHOD OF MANUFACTURING ELECTRODES FOR FLAT HEAT GENERATOR

(71) Applicant: TEM-TECH LAB. CO. LTD, Tokyo (JP)

(72) Inventors: Mitsuyoshi Aizawa, Tokyo (JP); Kisaku Nishiguchi, Tokyo (JP)

(73) Assignee: TEM-TECH. LAB CO. LTD., Tokyo (JP)

( * ) Notice: Subject to any disclaimer, the term of this patent is extended or adjusted under 35 U.S.C. 154(b) by 358 days.

(21) Appl. No.: 14/151,117

(22) Filed: Jan. 9, 2014

(65) Prior Publication Data

US 2014/0197157 A1 Jul. 17, 2014

(30) Foreign Application Priority Data

Jan. 17, 2013 (JP) ..... 006113/2013

(51) Int. Cl.
*H05B 3/03* (2006.01)
*H05B 3/34* (2006.01)
*H05B 3/36* (2006.01)

(52) U.S. Cl.
CPC .. *H05B 3/34* (2013.01); *H05B 3/03* (2013.01); *H05B 3/36* (2013.01); *H05B 2203/011* (2013.01); *H05B 2203/013* (2013.01); *H05B 2203/016* (2013.01)

(58) Field of Classification Search
None
See application file for complete search history.

(56) References Cited

U.S. PATENT DOCUMENTS 3,805,023 A * 4/1974 Wainer ..... C25D 5/02 106/1.13
4,555,414 A * 11/1985 Hoover ..... H01L 21/702 257/E21.533
4,666,735 A * 5/1987 Hoover ..... H01L 21/702 257/E21.533
5,911,899 A * 6/1999 Yoshikai ..... H05B 3/86 219/451.1
2007/0037040 A1* 2/2007 Koyama ..... H01M 8/0245 429/483
2007/0056957 A1* 3/2007 Diemer ..... B60N 2/5685 219/549
2010/0000981 A1* 1/2010 Diemer ..... H05B 3/146 219/202
2010/0258334 A1* 10/2010 Akaike ..... B60N 2/5685 174/126.1
2011/0220397 A1* 9/2011 Mizukoshi ..... H05K 1/142 174/251
2012/0125914 A1* 5/2012 Yue ..... H05B 3/34 219/548

FOREIGN PATENT DOCUMENTS

JP 2006119418 A * 5/2006
JP 2013211180 A * 10/2013

* cited by examiner

*Primary Examiner* — Joseph M Pelham

(74) *Attorney, Agent, or Firm* — Wenderoth, Lind & Ponack, L.L.P.

(57) ABSTRACT

A method of manufacturing electrodes for a flat heat generator is provided for creating electrodes in an arbitrary shape on an arbitrary site of an arbitrarily shaped flat heat generator, to allow a required portion to generate heat, and to allow a heat source to move. The method includes the steps of forming a negative film for ultraviolet exposure masking from a master which has a set of electrodes for the flat heat generator designed in an arbitrary shape and at an arbitrary site, forming a thin-film member including an uncured portion of epoxy film, by irradiating the thin-film member with ultraviolet rays through masking of the negative film, dissolving the uncured portion of epoxy resin with a developing solution to form the set of electrodes, and depositing a metal on the set of electrodes through an ionization reaction within an electrolytic solution bath to from an electrodes.

8 Claims, 7 Drawing Sheets

PRIOR ART

METHOD OF MANUFACTURING ELECTRODES FOR FLAT HEAT GENERATOR

TECHNICAL FIELD

The present invention relates to a method of manufacturing electrodes for a flat heat generator, such as a carbon fiber sheet, which generates heat through an electric action.

BACKGROUND ART

Flat heat generator for generating heat through an electric action are widely used in a variety of fields.

For example, a flat heat generator may be adhered to a mechanical device in order to maintain the same at a constant temperature, or a flat heat generator may be adhered around a liquid container when a liquid within the container needs to be prevented from freezing, or when the liquid needs temperature adjustments such as heat insulation, heating and the like. Similarly, a flat heat generator may be employed for a liquid carrier pipe which requires heat insulation by wrapping the flat heat generator around the pipe to prevent a liquid passing therethrough from cooling down. Also, a flat heat generator may be used as an underfloor heating sheet for residences. Further, a liquified gas for use in an industrial liquified gas supply station could be suddenly released to cause the temperature of the pipe to abruptly fall down. Depending on the type of the gaseous fluid, it can be crystallized to block the passage. Such a liquified gas supply station prevents the gaseous fluid from crystallization and deposition by heating the gaseous fluid with an electric wire heater or the like. Specifically, a variety of gas flow controllers including a pressure adjuster, a filter, a pressure sensor, a flow meter, and the like, which comprise such a liquified gas supply station, are covered with and heated by laminar flat heat generators, thereby preventing crystallization within the pipe.

A carbon fiber sheet is known to generate heat with electric power in accordance with its resistance, due to the fact that carbon is a conductor, when an electric potential is applied across electrodes attached to the carbon fiber sheet to cause a current to flow between the electrodes. In the past, when a carbon fiber sheet is employed as a flat heat generator for generating heat through an electric action, electrodes made of copper foil tape or silver paste are adhered to the carbon fiber sheet. Then, a heat-resistant agglutinant polyethylene film or agglutinant polyimide film is pressed over the carbon fiber sheet with a high-temperature, high-pressure press to form an insulating protective film. In this way, the flat heat generator is manufactured. Then, parts of the electrodes thus attached to the carbon fiber sheet are peeled off, and the peeled electrodes are used as power supply terminals.

FIG. 1 shows a top plan view of a conventional flat heat generator which employs a rectangular carbon fiber sheet 1 which comprises an electrode 2 made of a copper foil tape, a cross-sectional view of the flat heat generator, and a partially enlarged cross-sectional view of the flat heat generator. The carbon fiber sheet 1 is covered with an insulating protective film 3.

According to such a conventional flat heat generator, since the electrode can be merely adhered to the surface of the carbon fiber sheet, a large contact resistance is present between the electrode and the carbon fiber sheet, which can arise the following problems: a lower powering efficiency resulting from variations in contact resistance, heating due to a contact failure, and the like. Moreover, since the copper tape and silver paste for the electrode can be applied only at extremities of the carbon fiber sheet, the electrode cannot but being limited in shape.

SUMMARY OF INVENTION

It is a challenge of the present invention to provide a method of manufacturing an electrode for a flat heat generator, which is capable of making an electrode of an arbitrary shape at an arbitrary site on the flat heat generator, thereby enabling a current to locally concentrate on the flat heat generator, a current flow to move on a two-dimensional plane, only a required area to be heated, a heat source to be relocated, and the like.

It is another challenge of the present invention to provide a method of manufacturing an electrode for a flat heat generator, which permits the use of many types of electrode materials, without using an expensive copper foil tape or silver paste, and allows for manufacturing flat heat generators at a low cost and even in mass production.

It is a further challenge of the present invention to provide a flat heat generator which comprises an electrode manufactured by the method of the present invention.

According to the present invention, a method of manufacturing an electrode for a flat heat generator configured to generate heat by electric action, includes:

a first step of forming a thin-film member coated with an insulating film for the flat heat generator by printing a thin film of epoxy resin on both sides of the flat heat generator;

a second step of drying the thin-film member by heating the same;

a third step of designing a set of electrodes for the flat heat generator at an arbitrary position and in an arbitrary shape to create a master, overlaying an imaging film on the master, and forming a negative film for ultraviolet exposure masking through exposure processing;

a fourth step of overlaying the negative films on both sides of the thin-film member, and irradiating both sides of the thin-film member with ultraviolet rays to form a thin-film member which includes a cured portion of epoxy resin and an uncured portion of epoxy resin;

a fifth step of forming the set of electrodes by immersing the thin-film member irradiated with ultraviolet rays in a developing solution for developing, and dissolving the uncured portion of epoxy resin to expose the flat heat generator; and a sixth step of connecting a metal plate serving as an anode and the developed thin-film member serving as a cathode and subjected to plating to a power source, and immersing the metal plate and the developed thin-film member in an electrolytic solution bath to deposit a metal on the set of electrodes exposed on the flat heat generator through an ionization reaction to form the electrodes.

According to the present invention, since electrodes can be freely and efficiently formed in regard to the shape and site, a carbon fiber sheet can be formed freely in shape as a flat heat generator.

Also, according to the present invention, by designing the placement of electrodes on the carbon fiber sheet, the flat heat generator can be freely heated in an arbitrary part thereof.

Also, according to the present invention, the use of a screen printing/plating method allows for freely shaped electrodes and freely placed electrodes. Thus, by drawing a variety of electric flux on a carbon fiber sheet, the flat heat generator can be freely heated at an arbitrary site.

Further, according to the present invention, electrodes can be freely placed in free and miniature shape on a carbon fiber sheet, so that a variety of electromagnetic effects can be produced thereon. Further, by drawing electric flux, the present invention can be applied to biotechnology such as electrophoresis, and applications can be developed other than the heat generator.

DESCRIPTION OF EMBODIMENTS

The present invention will be described below with reference to specific embodiments.

A method of manufacturing an electrode for a carbon fiber sheet, used as a flat heat generator for generating heat through an electric action, will be described in accordance with respective steps.

Figure 1:
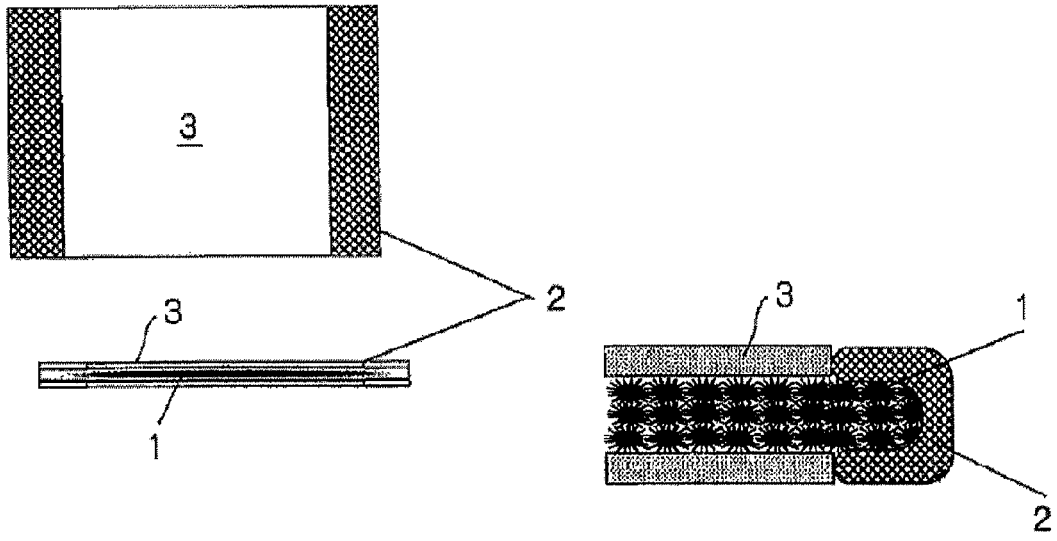
FIG. 1 shows a top plan view of a conventional flat heat generator which employs a rectangular carbon fiber sheet comprising an electrode 2 made of copper foil tape, a cross-sectional view of the fat heat generator, and a partially enlarged cross-sectional view of the flat heat generator.
Figure 2:
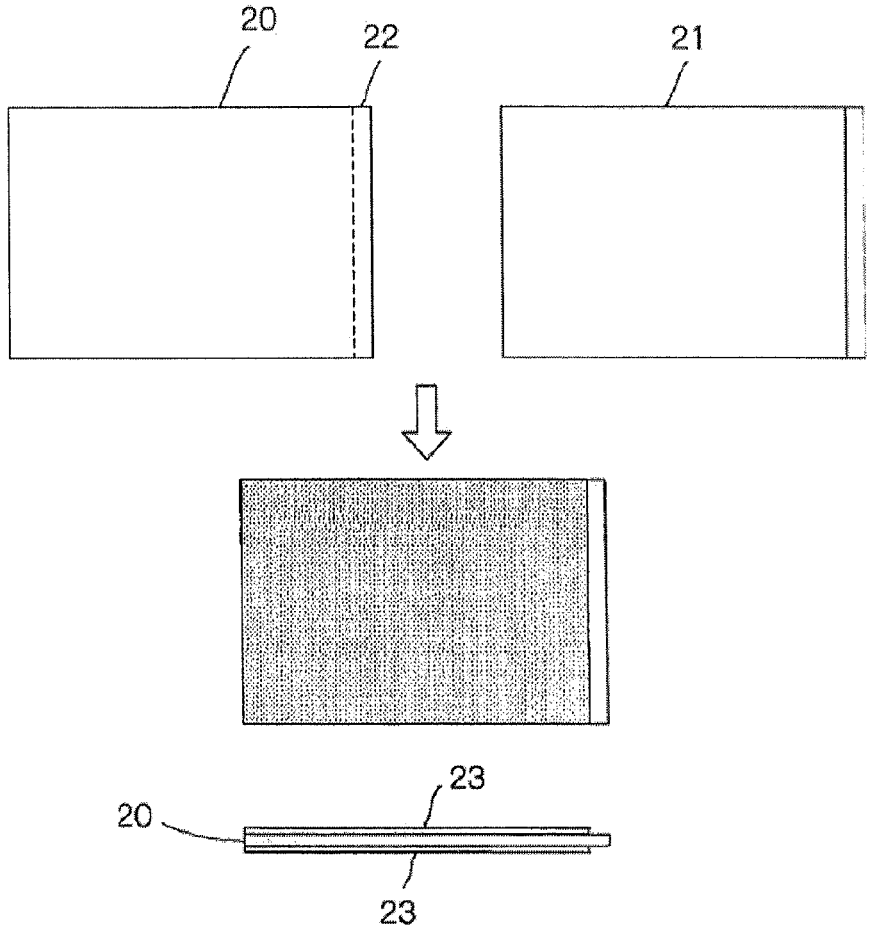
FIG. 2 shows a silk-screen based epoxy resin thin-film forming step which involves printing on a carbon fiber sheet an epoxy resin of the type developed with ultraviolet rays.

FIG. 2 shows a silk-screen based epoxy resin thin-film forming step which involves printing an epoxy resin of the type developed with ultraviolet rays, on a carbon fiber sheet, as a first step. First, a carbon fiber sheet 20 and silk screen stencils 21 are prepared. The silk screen stencils 21 are overlaid on both sides of the carbon fiber sheet 20 with a holding margin 22 remaining uncovered on the carbon fiber sheet 20. Then, epoxy resin thin-film is printed on each of the silk screen stencils 21 overlaid on both sides of the carbon fiber sheet 20 using screen printing. The epoxy resin is printed on the carbon fiber sheet 20 by a roller, and this step is repeated several times to form a rigid insulating film 23 through application of the epoxy resin.

The epoxy resin of the type developed with ultraviolet rays particularly excels in adhesion at high temperatures due to its high crosslink density and small free volume from a viewpoint of molecular structure. Further, epoxy resin of the type developed with ultraviolet rays has the following features:

(1) high storage stability (thermal stability);
(2) fast curing with ultraviolet irradiation, as compared with a thermally cured type;
(3) ability to cure at room temperature, and to cure at two stages with ultraviolet rays (UV) and heat;
(4) physical characteristics of cured product available substantially equivalent to those of the thermally cured type;
(5) ability to cure into an ultra-thin film; and
(6) ability to be developed with an alkali solution.

Figure 3:
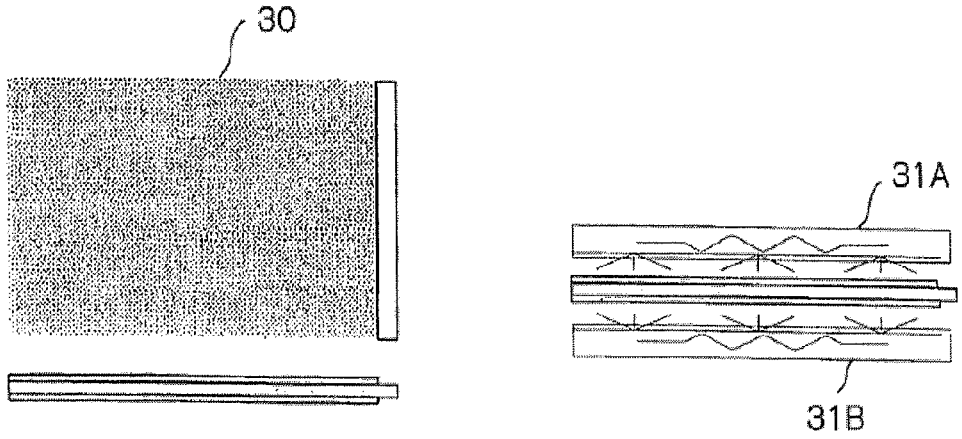
FIG. 3 shows a pre-cure step (heat dry step) which involves heating and drying a thin-film member made of a carbon fiber sheet covered with an epoxy resin insulating film.

FIG. 3 shows a pre-cure step (thermal dry step) as a second step. The thin-film member 30 formed in the first step comprises a carbon fiber sheet 20, and the epoxy resin insulating films 23 applied on both sides of the carbon fiber sheet 20. The thin-film member 30 is heated with heaters 31A, 31B from both sides thereof for drying. Specifically, the thin-film member 30 is heated for 20-30 minutes at approximately 800° C.

Figure 4:
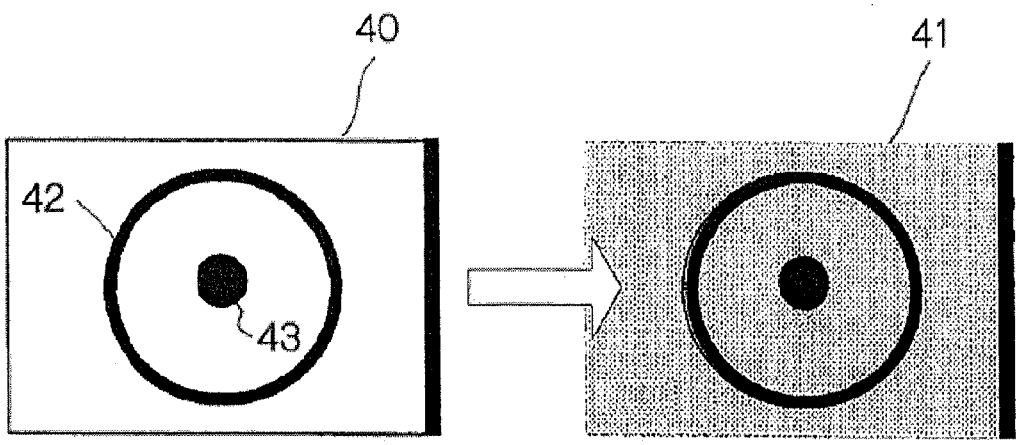
FIG. 4 shows a designing and creating step for creating a negative film conforming to a set of electrodes for ultraviolet exposure masking through exposure processing.

FIG. 4 shows a designing and creating step for creating a negative film for a set of electrodes. A set of electrodes is designed in an arbitrary shape and at an arbitrary site to create a master 40. Then, an imaging film is overlaid on the master, and a negative film 41 is formed for ultraviolet exposure masking through exposure processing. In the illustrated embodiment, a flat heat generator is assumed to be of a disk shape, and the set of electrodes is shown as a peripheral electrode 42 and a central electrode 43. However, the set of electrodes is not limited to the discoidal one, but can be designed in an arbitrary shape.

Figure 5:
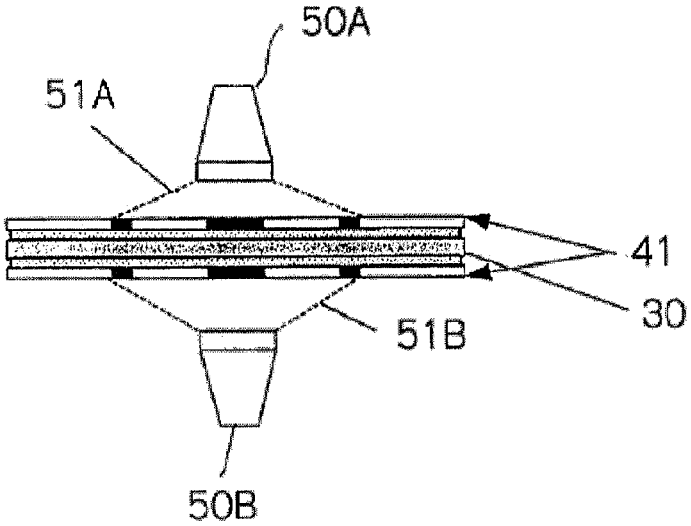
FIG. 5 shows an exposure step which involves irradiating ultraviolet rays to expose only an epoxy resin of a thin-film member which is not masked by a negative film.

FIG. 5 shows an exposure step which involves irradiation of ultraviolet rays, as a fourth step. After the pre-cure step, the negative film 41 for ultraviolet exposure masking is overlaid on each of both sides of the thin-film member 30 comprising the carbon fiber sheet 20 applied (covered) with the epoxy resin insulating films 23. The resulting laminate is irradiated with ultraviolet rays from both sides of the thin-film member 30 by ultraviolet irradiators 50A, 50B to expose and cure the epoxy resin of the thin-film member 30 which is not masked by the negative films 41. In particular, ultraviolet rays in the range of 280 to 450 nm is effective for curing as an ultraviolet lamp output of the ultraviolet irradiators.

The thin-film member 30 which has undergone the exposure processing with the irradiation of ultraviolet rays includes a cured portion 61 of the epoxy resin and uncured portions 62 of the epoxy resin, by the action of the masking provided by the negative films 41, where the uncured portions 62 of the epoxy resin correspond to the peripheral electrode 42 and central electrode 43.

Figure 6:
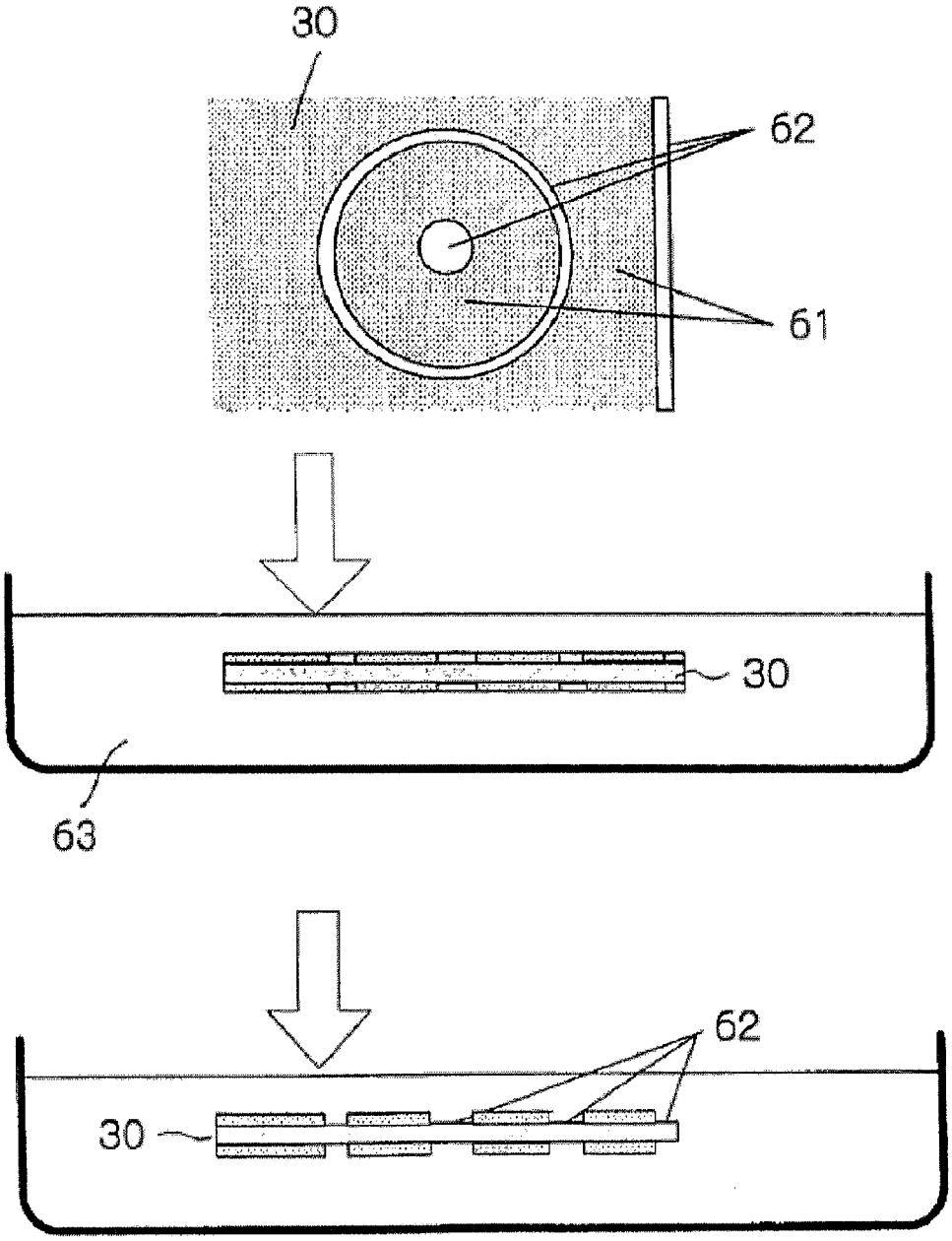
FIG. 6 shows a developing step for developing the thin-film member exposed with the irradiated ultraviolet rays.

FIG. 6 shows a developing step for the thin-film member 30 which has been exposed with the irradiated ultraviolet rays, as a fifth step. The exposed thin-film member 30 is immersed in a developing solution, e.g., an alkali solution, so that the uncured epoxy resin is dissolved, while the cured epoxy resin remains. The developing solution used herein may be an alkali solution such as tetramethyl ammonium hydroxide, sodium hydroxide, sodium carbonate, and the like, or an organic solution such as N-methylpyrolidone and the like, in order to restrict its influence on the environment. As a result of this step, the dissolution of the uncured epoxy resin causes the exposure of portions corresponding to the peripheral electrode 42 and central electrode 43 of the carbon fiber sheet 20.

Figure 7A:
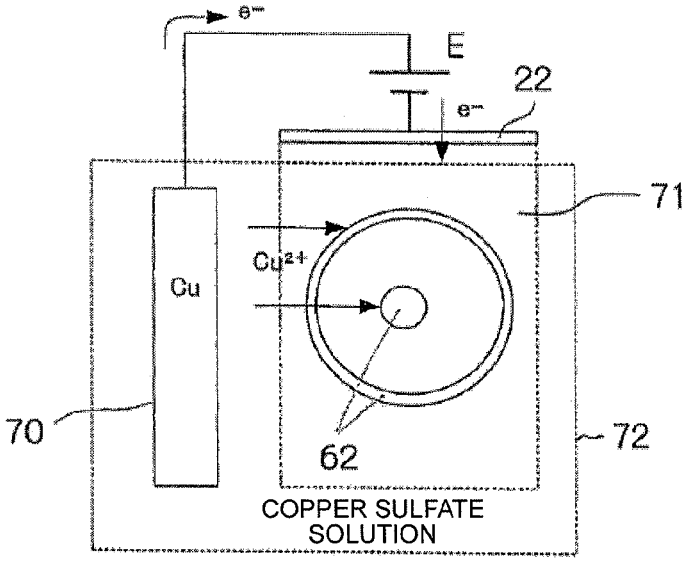
FIG. 7A shows a diagram for describing the principle of a plated electrode deposition step for forming the thin-film member with a copper electrode.

FIG. 7A shows a diagram for describing the principle of a plated electrode deposition step with an electrolytic solution. A copper plate 70 serving as an anode, and a thin-film member 71 (30) serving as a cathode are connected to a direct-current power source E across a holding margin 22 of the thin-film member 71 (30). The thin-film member 71 has been developed, and is subjected to plating. The copper plate 70 and thin-film member 71 are then immersed in a copper sulfate solution bath 72. As a direct-current voltage is applied from the direct-current power source E to the copper plate 70 and thin-film member 71 immersed in the copper sulfate solution bath 72, a cathode reaction (CU2++2e−→Cu) occurs on the thin-film member 71, while an anode reaction (Cu→Cu2++2e−) occurs on the copper plate 70.

More specifically, as a direct-current voltage is applied from the direct-current power source E, copper sulfate and sulfuric acid are dissociated, respectively, and exist as Cu2+, H+, HSO4−, and SO42− ions. Since electrons cannot intrude into a solution, a current is carried through migration of these ions within a solution. Electrons are carried, through an external circuit, to the thin-film member 71 which serves as a cathode that is subjected to plating, and Cu2+ ions within the solution are reduced on the surface of the thin-film member 71 (electrode interface) to deposit metal copper, thus forming a copper coating on the thin-film member 71. In this event, since the thin-film member 71 includes the cured portion 61 of epoxy resin and the uncured portions 62 of epoxy resin, by the action of the masking of the negative film 41, the metal copper is deposited to form the copper coating only on the uncured portions 62 of epoxy resin which correspond to the peripheral electrode 42 and central electrode 43.

On the other hand, a reverse phenomenon occurs on the copper plate 70 which serves as an anode, where an ionization reaction occurs on the interface between the copper plate 70 and the solution, and copper releases electrons and eludes into the solution as Cu2+ ions. The released electrons enter a terminal of the direct-current power source E through the copper plate 70 and a conductor line, and are supplied to the thin-film member 71 through a conductor line.

Figure 7B:
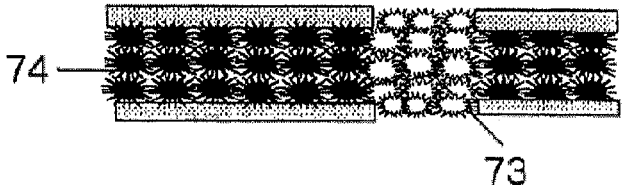
FIG. 7B shows a partial cross-section of a thin-film member which comprises a copper electrode formed through the plated electrode deposition step.

FIG. 7B shows a partial cross-sectional view of the thin-film member 71 which comprises a copper electrode 73 that has been formed through the plated electrode deposition step. Since carbon and cellulose fiber exhibit a good affinity, carbon particles 74 firmly fixed on the fiber couple with Cu2+ ions and infiltrate deep into carbon fibers. Thus, the deposited copper electrode 73 exhibits a very low contact resistance, and integrates with the carbon fiber sheet without peeling. Consequently, the copper electrode 73 exhibits an extremely high conductivity.

Figure 7C:
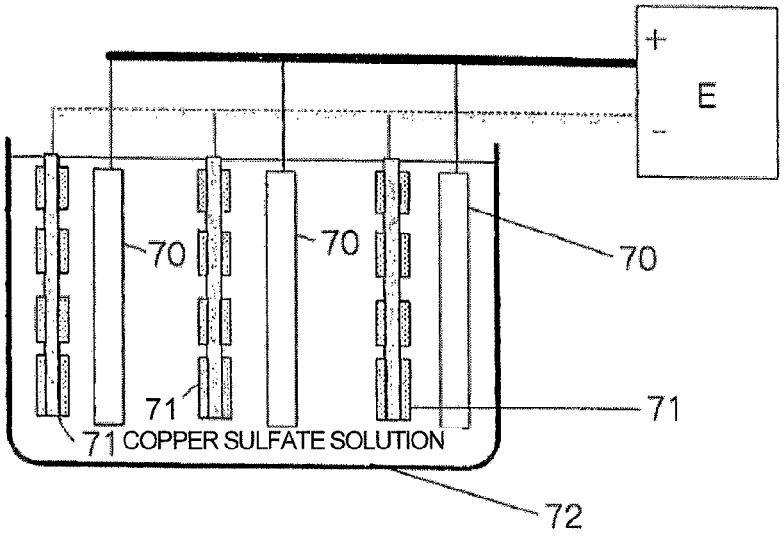
FIG. 7C shows an imaginal representation of manufacturing multiple thin-film members, each comprising a copper electrode through the plated electrode deposition step.

FIG. 7C shows an imaginal representation of manufacturing multiple thin-film members 71 through the plated electrode deposition step. The copper plate 70 serving as an anode, and the thin-film member 71 (30) serving as a cathode and subjected to plating are formed into a pair, and a multiplicity of such pairs (three pairs in FIG. 7C) of the copper plates 70 and thin-film members 71 are connected to the direct-current power source E, and immersed in the copper sulfate solution bath 72.

Figure 8A:
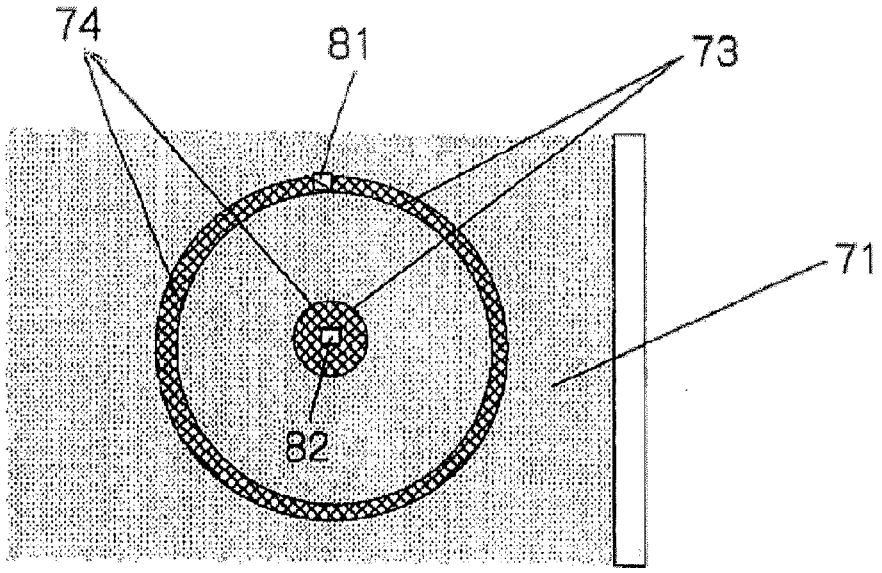
FIG. 8A shows a thin-film member formed with copper electrodes through the plated electrode deposition step, which has passed through a post-cure and finishing step for stabilizing the thin-film member.
Figure 8B:
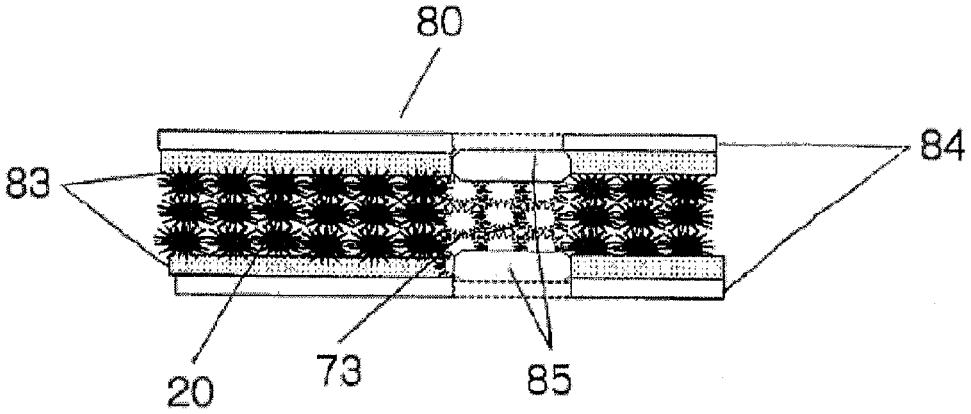
FIG. 8B shows a partial cross-section of a completed discoidal flat heat generator.

FIG. 8A shows the thin-film member 71 which has copper electrodes 73 (peripheral electrode 42 and central electrode 43) after it has undergone a post-cure and finishing step. The thin-film member 71 formed with the copper electrodes 73 through the plated electrode deposition step is washed with water to rinse the remaining copper sulfate solution therefrom, and dried. Subsequently, the dried thin-film member 71 is stabilized by processing, called "post-cure," for thermally curing epoxy resin again at high temperature of 150° C. The stabilized thin-film member 71 is laminated with a polyethylene film or the like as a protective material for reinforcement. In the reinforced thin-film member 71, for forming a power supply terminal on part of each of the peripheral electrode 42 and central electrode 43 of the formed copper electrodes 73, the laminate member is removed from the part of each electrode at which the power supply terminal is to be formed, to expose portions 81, 82 of the peripheral electrode 42 and central electrode 43. Then, solder plating or the like is applied to the exposed portions of the copper electrodes 73, such that the plating serves as power supply terminals. Finally, an unnecessary portion outside the peripheral electrode 42 is cut out. FIG. 8B shows a partial cross-section of a completed discoidal flat heat generator 80, where the flat heat generator 80 is comprised of the carbon fiber sheet 20, cured epoxy resin layers 83 on both sides of the carbon fiber sheet 20, and laminate layers 84, made of polyethylene film or the like, on both sides. The copper electrode 73 is formed with power supply terminals 85 on both sides thereof.

As described above, by performing the first through seventh steps, a discoidal flat heat generator can be manufactured by forming electrodes on a carbon fiber sheet which generates heat through electric action.

According to the present invention, metal plating can be applied to a very fragile and soft carbon fiber sheet to form electrodes thereon. For the carbon fiber sheet, carbon fiber paper, carbon fiber cloth can be used, and in place of copper, metal plating of silver, gold and the like enables a metal to be deposited not only on the surface of the carbon fiber sheet but also deep into the fibers at high densities.

Figure 9A:
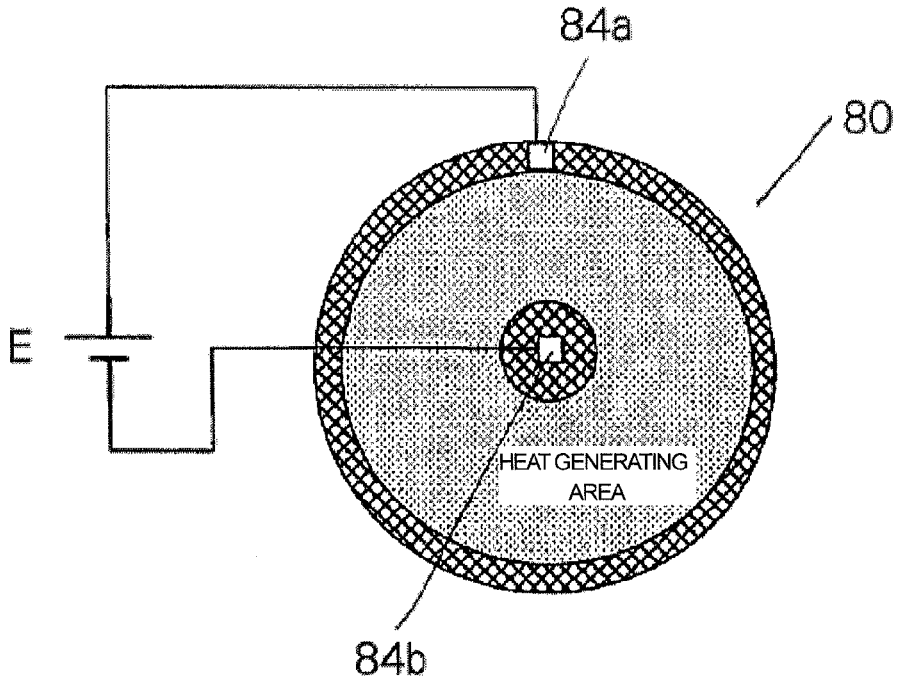
FIG. 9A shows how to use a discoidal flat heat generator which comprises electrodes, manufactured according to the present invention.

FIG. 9A shows, in a simple way, how to use a discoidal flat heat generator 80, which comprises electrodes, manufactured according to the present invention. As a power source E is connected between a power supply terminal 84*a* on a peripheral electrode (positive electrode) and a power supply terminal 84*b* on a central electrode (negative electrode), the carbon fiber sheet generates heat with power in accordance with its resistance.

Figure 9B:
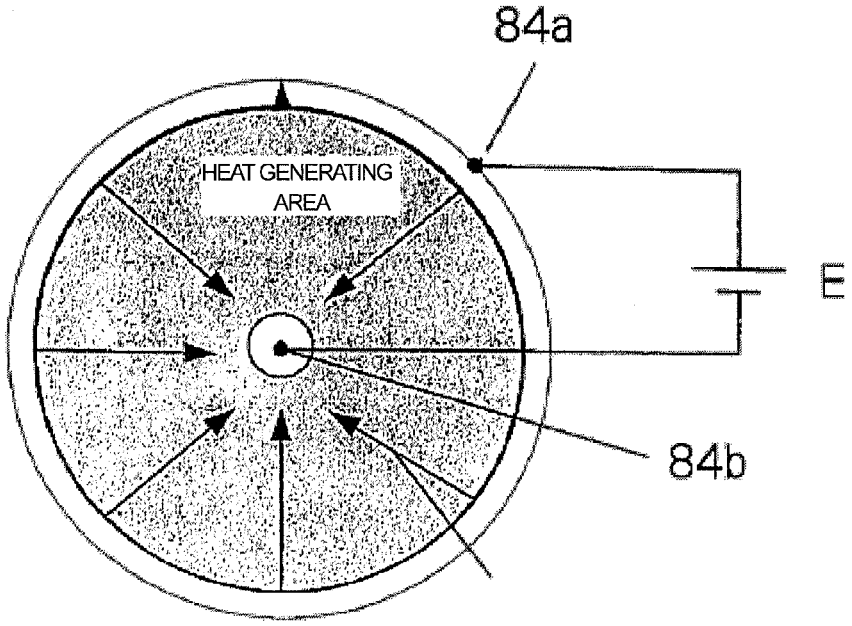
FIG. 9B shows a manner of using a discoidal flat heat generator which comprises electrodes, manufactured according to the present invention.

Likewise, FIG. 9B shows, in a simple way, how to use a discoidal flat heat generator 80, which comprises electrodes, manufactured according to the present invention. The figure shows the direction in which electric flux 90 travels from the peripheral electrode to the central electrode when a power source E is connected between a power supply terminal 84*a* on a peripheral electrode and a power supply terminal 84*b* on a central electrode.

What is claimed is:

1. A method of manufacturing an electrode for a flat heat generator configured to generate heat by an electric action, comprising:

a first step of forming a thin-film member coated with an insulating film for said flat heat generator by printing a thin film of epoxy resin on both sides of said flat heat generator;

a second step of drying said thin-film member by heating the same;

a third step of designing a set of electrodes for said flat heat generator at an arbitrary position and in an arbitrary shape to create a master, overlaying an imaging film on said master, and forming a negative film for ultraviolet exposure masking through exposure processing;

a fourth step of overlaying said negative films on both sides of said thin-film member, and irradiating both sides of said thin-film member with ultraviolet rays to form a thin-film member which includes a cured portion of epoxy resin and an uncured portion of epoxy resin;

a fifth step of forming the set of electrodes by immersing said thin-film member irradiated with ultraviolet rays in a developing solution for developing, and dissolving the uncured portion of epoxy resin to expose said flat heat generator; and a sixth step of connecting a metal plate serving as an anode and the developed thin-film member serving as a cathode and subjected to plating to a power source, and immersing said metal plate and said developed thin-film member in an electrolytic solution bath to deposit a metal on the set of electrodes exposed on said flat heat generator through an ionization reaction to form the electrodes.

2. A method according to claim 1, further comprising a seventh step of stabilizing said dried thin-film member by again thermally curing said cured epoxy resin at high temperature, after rinsing off the electrolytic solution attached to said thin-film member formed with said electrodes and drying said thin-film member.

3. A method according to claim 2, further comprising an eighth step of laminating said stabilized thin-film member with a polyethylene film as a protective material for reinforcement.

4. A method according to claim 1, wherein said electrolytic solution is a copper sulfate solution, and metal copper is deposited on the exposed set of electrodes of said flat heat generator.

5. A method according to claim 1, wherein said flat heat generator is a discoidal carbon fiber sheet.

6. A method according to claim 1, wherein said exposed set of electrodes of said flat heat generator is formed to be a peripheral electrode and a central electrode of said flat heat generator.

7. A method according to claim 6, wherein a power supply terminal is disposed on a part of said peripheral electrode and a part of said central electrode, respectively.

8. A flat heat generator comprising electrodes manufactured by a method according to claim 1.

* * * * *